United States Patent [19]

Barns et al.

[11] Patent Number: 4,602,146

[45] Date of Patent: Jul. 22, 1986

[54] HAND HELD HAIR DRYER

[75] Inventors: Ileana D. Barns, Weston; Raymond W. Kunz; James G. Montagnino, both of Monroe; Herbert M. Morrison, Trumbull, all of Conn.

[73] Assignee: Clairol Incorporated, New York, N.Y.

[21] Appl. No.: 597,963

[22] Filed: Apr. 9, 1984

[51] Int. Cl.[4] ..... F24H 3/04; A45D 20/12

[52] U.S. Cl. ..... 219/373; 219/367

[58] Field of Search ..... 219/366, 367, 368, 369, 219/370, 371, 372, 373, 374; 34/96, 97, 98, 243 R; 239/579, 541, 587, 455

[56] References Cited

U.S. PATENT DOCUMENTS

| | | | |
|---|---|---|---|
| 1,765,380 | 6/1930 | McGinnis | 34/99 |
| 1,936,311 | 11/1933 | Schramm | 219/370 |
| 2,970,432 | 2/1961 | Cocoros | 239/455 |
| 3,518,776 | 7/1970 | Wolff | 219/370 |
| 4,097,722 | 6/1978 | Soler | 219/368 |
| 4,218,608 | 8/1980 | Maroney | 219/370 |
| 4,232,454 | 11/1980 | Springer | 219/368 |
| 4,366,368 | 12/1982 | Stephens | 219/370 |
| 4,391,047 | 7/1983 | Janssens | 34/97 |

FOREIGN PATENT DOCUMENTS

| | | | |
|---|---|---|---|
| 568043 | 2/1931 | Fed. Rep. of Germany | 34/243 R |
| 2123688 | 2/1984 | United Kingdom | . |

*Primary Examiner*—Clarence L. Albritton
*Assistant Examiner*—Teresa J. Walberg
*Attorney, Agent, or Firm*—J. J. Balser; G. Warzecha

[57] ABSTRACT

A diffusion device is provided within or as an attachment to the nozzle of a hair dryer which provides a nearly constant air volume at varying velocities. A hair dryer improvement for varying the air flow output from the hair dryer nozzle. The improvement is a diffusion device which consists of a pair of vanes pivotally mounted downstream of the nozzle. Placement of the vanes in varying positions causes the output air flow to be either concentrated along the nozzle axis or diffused by causing varying portions of the air flow to be directed through the peripheral side wall of the diffusion device. Since the diffusion device offers very little obstruction to the air flow, the volume of air remains nearly constant for the varying diffuser vane positions.

6 Claims, 5 Drawing Figures

HAND HELD HAIR DRYER

The present invention relates to an improved, hot air device for drying the hair. More particularly, the invention relates to a novel means of controlling the air velocity produced by hair dryers while maintaining a relatively constant air volume.

Prior art hair drying devices have been designed and marketed in a wide variety of styles. However, all such devices basically include a fan, a heating element and a housing. The fan draws ambient temperature air into the housing, moving it across an activated heating element and discharges the heated air through a discharge nozzle. In addition, the dryer is also generally provided with thermostatic means for controlling the temperature of the heated air. The dryer hot air discharge is generally configured in the shape of a bonnet which fits over the head or in the shape of a discharge nozzle adapted to direct the air flow to a restricted area. Other features which are frequently provided are fan speed controls to provide two or more fan speeds and heat level controls to provide two or more air temperatures.

Retail consumers are generally offered two types of hair dryers, the bonnet or the hand held dryer. The hand held dryers most frequently have a pistol grip to facilitate holding the appliance and are provided with a nozzle which offers a unidirectional flow of air with fixed velocity for each fan speed and which can be used to assist in hair styling. However, if the user wishes to change the diffusion pattern, it is necessary to attach or detach a nozzle adapter with a different size orifice. This has a disadvantage, as the user cannot readily change the diffusion range without physically attaching or detaching various nozzle adapters.

It is desirable to provide the user with a device that has a broad range of air diffusion patterns at any air setting which can provide a concentrated or dispersed air stream appropriate for different hair styles.

SUMMARY OF THE INVENTION

The present invention provides a novel means for controlling the air velocity pattern and air flow distribution from the nozzle of a hair dryer. The unique diffuser employed in the present invention permits simple, inexpensive construction while providing maximum diffusion.

It is an object of the present invention to provide an improved, hair dryer which can provide a wide range of air velocity and air diffusion patterns.

It is a further object of the present invention to provide a hair dryer having a discharge nozzle capable of providing a relatively constant air volume at varying air velocities without changing the air setting.

The diffusion system of the present invention is designed to provide a nearly constant volume of air at any setting of the diffuser vanes, over the maximum to minimum diffusion range. Moveable, deflectors or vanes divert the basic concentrated flow through a series of radial slots or other openings in the circumference of the nozzle which are progressively exposed to air flow as additional diversion is required. When returning to a concentrated air flow, the deflectors or vanes restrict the openings, collimating flow into a narrow beam of high velocity. When the slots are opened, a broad cone shaped flow pattern of diffused air with relatively low velocities is obtained. In the preferred embodiment, using a tubular discharge nozzle, the air flow cone envelope is varied by the position of two pivoted vanes. At minimum dispersion or cone angle, the diffuser vanes are parallel to the basic flow within the dryer exit nozzle, causing little or no changes in the cone angle. As the vane attack angles are increased relative to the basic dryer air flow, the main flow is diverted through radial slots in the discharge nozzle. This increases the cone angle pattern and decreases air velocity within the cone for soft styled hair.

DESCRIPTION OF THE INVENTION

Figure 1:
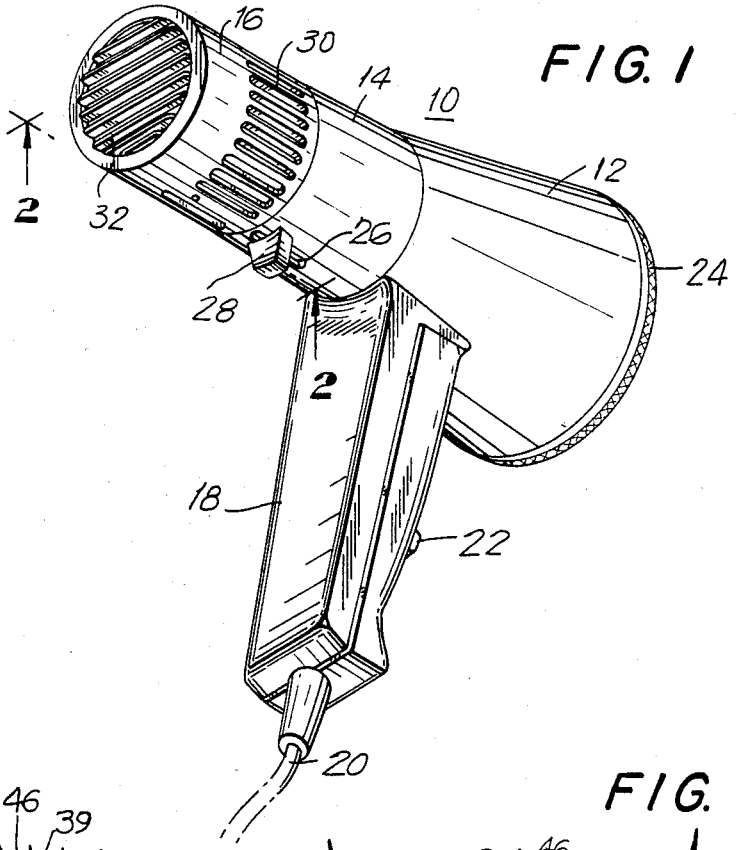
FIG. 1 is a perspective view of a preferred embodiment of the hair dryer of the present invention.

As shown in the drawings, the hair dryer 10 of the present invention comprises a rear housing section 12, a central housing section 14, a tubular nozzle section 16 and a handle section 18. Rear housing section 12 has an air intake screen 24 located at the distal end and contains within an electric heating element and an electric fan or impeller, not shown, to move air across the heating element and to discharge the same from the tubular nozzle section 16. Central housing section 14 connects rear housing section 12 to tubular nozzle section 16 and has located on its lower surface, cutout 26 in which diffuser vane actuator control lever 28 is slidably located. Handle section 18 is displaced below rear housing 12 in the form of a hand or pistol grip and has located therein electric power supply line cord 20 and switches 22 to control the heat range and air velocity. Tubular nozzle section 16 is provided with a series of longitudinal slots 30 located around the circumference which communicate with the interior of nozzle 16. The discharge end of tubular nozzle section 16 is provided with louvres 32. Diffuser vanes 34,36 are disposed within tubular nozzle section and pivotally mounted on pivot pins 38,40. Preferably, rear edges 54,56 of diffuser vanes 34,36 are configured to provide an orifice 48 in the closed position which permits partial air flow through the center of the dryer and provides maximum diffusion. Affixed to diffuser vanes 34,36 respectively are one end of diffuser pins 42,44 respectively. The opposite end of said diffuser pins 42,44 engage actuator pin tracks 43,45 in diffuser vane actuator 46 which is slidably disposed within tubular nozzle section 16 and operated by diffuser vane actuator control lever 28. Diffuser vane actuator 46 is provided with actuator pin tracks 43,45 and a central pivot pin track 39. The forward end of actuator pin tracks 43,45 are adjacent to the midpoint of central pivot pin track 39 and each forms an acute angle with the longitudinal axis of central pivot pin track 39.

Figure 2:
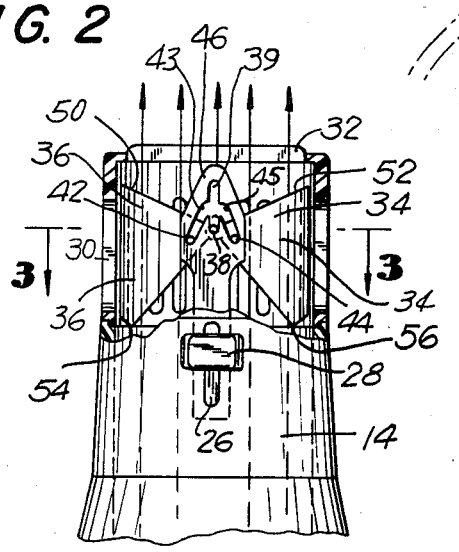
FIG. 2 is a partial cut-away view of the dryer of the present invention taken along line 2—2 showing the diffuser vanes in the minimum diffusion air flow position.
Figure 4:
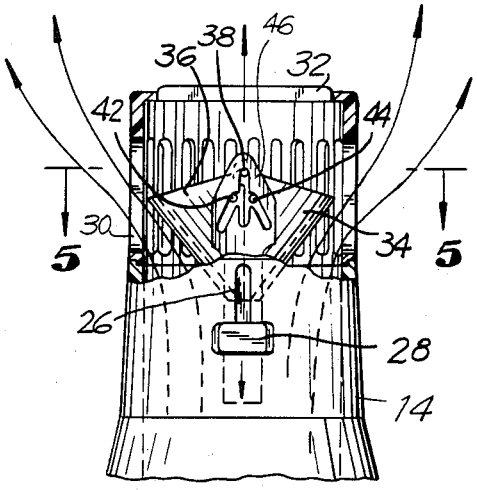
FIG. 4 is a partial cut-away view of the dryer of the present invention taken along line 2—2 showing the diffuser vanes in the maximum diffusion air flow position.
Figure 3:
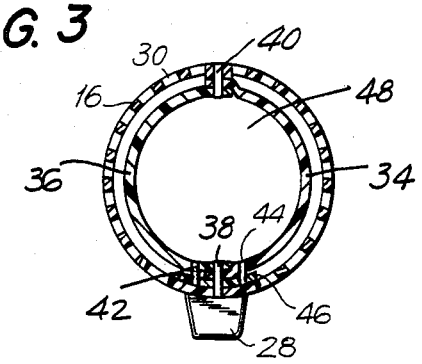
FIG. 3 is a cross-sectional view of FIG. 2 taken along line 3—3 showing the diffuser vanes in the minimum diffusion air flow position.
Figure 5:
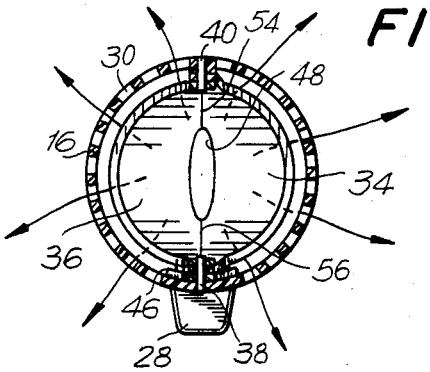
FIG. 5 is a cross-sectional view of FIG. 4 taken along line 5—5 showing the diffuser vanes in the maximum diffusion air flow position.

In use, the operator can change the air flow pattern merely by sliding diffuser vane actuator control lever 28 either forward or rearward. As diffuser vane actuator control lever 28 is moved forward, the diffuser vanes are moved apart as shown in FIGS. 2 and 3 by the action of diffuser pins 42,44 riding in diffuser pin tracks 43,45. In this position, the air flow pattern and velocity is concentrated and is most desirable for use in hair styling. As diffuser vane actuator control lever 28 is moved rearwardly, diffuser vane actuator 46 moves rearwardly, diffuser pin tracks 43,45 cause diffuser pins 42,44 to move toward each other and in turn the rearward ends of diffuser vanes 34,36 move towards each other, thereby reducing the dimensions of central orifice 48. As the rearward ends of diffuser vanes 34, 36 move towards each other, longitudinal slots 30, which were closed by the outer walls of diffuser vanes 34, 36 adjacent to said slots become uncovered as shown in FIGS. 4 and 5. The narrowing of central orifice 48 changes the vane attack angle and the air flow pattern and air flow is directed around the outer walls of diffuser vanes 34,36 and through longitudinal slots 30, creating a broader air flow pattern. The farther rearwardly that diffuser vane actuator control lever 28 is moved, the greater the diffusion of the air stream. While the diffuser vane actuator control lever 28 is shown in the drawings located below tubular nozzle section 16, it is to be understood that the precise position of the control lever is not critical. If desired, the control lever could be mounted on handle section 18 in the form of a trigger or squeeze lever.

Where a greater concentration of air flow is desired, the diffuser vanes 34,36 may be adjusted to allow movement slightly past their parallel position as shown in FIG. 3 so that their leading or front edges move toward each other thereby increasing the effective entrance diameter of central orifice 48 and decreasing the exit diameter. This tends to further narrow the exit cone angle, increasing air flow velocities.

Although the above description has set forth the present invention in the form of a preferred embodiment, it is apparent that nozzles having other appropriate geometrical configurations could also be employed. For example, a rectangular or square nozzle wherein a door or pair of doors is located forward of the peripheral openings in the nozzle and which would pivot at the sides rather than the center could be employed. The vanes would swing rearward against the peripheral openings to close them and provide a concentrated air flow pattern. As the non-fixed edges of the vanes are moved forward, the air flow pattern would change to a more diffuse pattern. Moreover, the deflectors or vanes could be of various geometric configurations, such as a movable cone or bellows, which can be manipulated to change the orifice of the hair dryer in such a way as to provide nearly constant air volume while changing the air flow pattern and velocity.

It will be apparent that other modifications and variations may be made without departing from the spirit or the scope of the invention, as defined by the appended claims.

What is claimed is:

1. In a hair dryer having heating means disposed therein, air moving means for moving a stream of air over said heating means and axially out of air discharge means, the improvement which comprises:

air discharge means comprising a nozzle having a discharge end and a plurality of openings symmetrically located in the periphery of said nozzle;

a pair of diffuser vanes for directing air flowing through said air discharge means, said vanes pivotally mounted within said nozzle symmetrically to the axis thereof and adjacent to said openings, said diffuser vanes adapted to being placed in either a closed position for directing a portion of said stream of air through said discharge end and a portion thereof substantially axially through said openings, or an open position for directing substantially all of said stream of air through said discharge end by sealing said openings;

and means for changing the position of said diffuser vanes relative to said openings.

2. A dryer according to claim 1 wherein said air discharge means is integrally formed with said dryer.

3. In a hair dryer having heating means disposed therein, air moving means for moving a stream of air over said heating means and axially out of air discharge means, the improvement which comprises:

tubular air discharge means comprising a nozzle having a discharge end and a plurality of openings in a side of said nozzle;

a pair of diffuser vanes for directing air flowing through said air discharge means, said vanes pivotally mounted within said nozzle symmetrically to the axis thereof and adjacent to said openings, said diffuser vanes adapted to being placed in either a closed position for directing a portion of said stream of air through said discharge end and a portion thereof substantially axially through said openings, or an open position for directing substantially all of said stream of air through said discharge end by sealing said openings;

and means for changing the position of said diffuser vanes relative to said openings.

4. The dryer according to claim 3 wherein said diffuser vanes are mounted on a pair of diametrically opposed pivot pins secured to said nozzle and wherein said diffuser vanes each have an actuating pin extending therefrom parallel with and adjacent to one of said pivot pins and wherein said means for changing the position of said diffuser vanes comprises a diffuser vane actuator said diffuser vane actuator having an axially aligned pivot pin channel for receiving said one of said pivot pins and a pair of actuating pin cam tracks each for receiving one of said actuating pins, each of said actuating pin cam tracks being in the same plane as and symmetrical with said pivot pin channel and intersecting said pivot pin channel at a predetermined angle, whereby upon reciprocal longitudinal motion of said diffuser vane actuator said actuating pins will follow within their respective cam tracks to cause each of said diffuser vanes to which said actuating pins are attached to be pivoted about said pivot pins.

5. The dryer according to claims 3 or 4 wherein said tubular nozzle has a plurality of longitudinally aligned slots in the side of said nozzle.

6. An air diffuser attachment for being mounted to the nozzle of a hair dryer comprising:

a tubular air discharge means, the axis of said tubular means for being aligned with the axis of said nozzle, said tubular means having a plurality of apertures in a surface thereof;

a pair of diffuser vanes for directing air flowing through said tubular means, said vanes being pivotally and symmetrically mounted within said tubular means; and means for placing said vanes into an open position for directing substantially all the air to flow through said tubular means or a closed position for directing a portion of the air flow emanating from said nozzle through said tubular means and a portion thereof substantially axially through said apertures.

* * * * *